United States Patent [19]

Kumagai et al.

[11] Patent Number: 4,556,877

[45] Date of Patent: Dec. 3, 1985

[54] DIGITAL DISPLAY DEVICE HAVING A CONTROLLING APPARATUS RESPONSIVE TO LOW TEMPERATURES

[75] Inventors: Naotake Kumagai; Ikuo Saga; Minoru Tatemoto; Tetsuya Tada, all of Okazaki, Japan

[73] Assignee: Mitsubishi Jidosha Kogyo Kabushiki Kaisha, Tokyo, Japan

[21] Appl. No.: 418,300

[22] Filed: Sep. 15, 1982

[30] Foreign Application Priority Data

Jan. 22, 1982 [JP] Japan ..... 57-8413

[51] Int. Cl.[4] ..... G09G 3/00

[52] U.S. Cl. ..... 340/713; 340/805

[58] Field of Search ..... 340/713, 714, 784, 785, 340/802, 805

[56] References Cited

U.S. PATENT DOCUMENTS 3,973,254 8/1976 Nomiya et al. ..... 340/802

4,236,150 11/1980 Chern ..... 340/713

*Primary Examiner*—Marshall M. Curtis

*Attorney, Agent, or Firm*—Robert E. Burns; Emmanuel J. Lobato; Bruce L. Adams

[57] ABSTRACT

A digital display device which has a delay circuit for operating a segment on-off driver so that when the ambient temperature at the time of renewing display is lower than a predetermined value, an OFF signal is sent to an ON segment and then, after the lapse of a predetermined time, an ON signal is sent to an OFF segment. Consequently, the overlap time between the segment to which an OFF signal was newly transmitted and the segment to which an ON signal was newly transmitted, can be made very short or eliminated whereby the discriminatability is improved to prevent misunderstanding of the display.

13 Claims, 12 Drawing Figures

DIGITAL DISPLAY DEVICE HAVING A CONTROLLING APPARATUS RESPONSIVE TO LOW TEMPERATURES

BACKGROUND OF THE INVENTION

1. Field of the Invention

The present invention relates to an improvement of a digital display device using segments formed of liquid crystal or electrochromic material.

2. Description of the Prior Art

Heretofore, liquid crystal and electrochromic have been used in a 7-segments digital display device. But, for example, in the case of liquid crystal, its response time greatly lowers as the ambient temperature falls as is shown in FIG. 1. In case such a digital display device is used as a vehicular speedometer, the meter reading is renewed at every 400 msec. In this case, if ON segments at −10° C. are turned off and at the same time OFF segments are turned on, the afterglow of the segments which are turned off and the light of the segments which are turned on overlap for a period of about 150 msec. Consequently, for example, when the display "1" is about to change into "2", since the segments of "1" do not disappear immediately, there temporarily appears a non-numeric display of "d" resulting from overlap of "1" and "2". As a result, the discriminatability is deteriorated and the driver may have a misunderstanding of display or may consider that the speedometer is defective.

SUMMARY OF THE INVENTION

The present invention eliminates the above-mentioned drawbacks. It is the object of the present invention to provide a digital display device whereby a proper display is made even at the time of renewal of display, that is, even at the time of transfer from a display at a certain time to a display at a subsequent time.

In order to achieve the above-mentioned object, the digital display device of the present invention for making a digital display while renewing display at every fixed time using many segments, comprises a driver for turning on and off those segments and a delay circuit for operating the driver so that when the ambient temperature at the time of renewing display is lower than a predetermined value, OFF signals are sent to ON segments and then, after the lapse of a predetermined time, ON signals are sent to OFF segments.

According to the digital display device of the present invention, the driver is operated so that when the ambient temperature is lower than a predetermined level, the driver is operated so as to send ON signals to segments to be newly turned on after the lapse of a predetermined time from the time when the driver was operated to send OFF signals to the segments which were ON. Consequently, the overlap time between the segments which are becoming indiscriminatable can be made very short or eliminated whereby the discriminatability is improved to prevent misunderstanding of display.

BRIEF DESCRIPTION OF THE DRAWINGS

FIGS. 3 through 6 show a digital display device according to a first embodiment of the present invention, in which FIG. 3 is a perspective view thereof, FIG. 4 is a sectional view thereof, FIG. 5 is a circuit diagram thereof and FIG. 6 is a graph showing transmittance vs. time in the digital display device;

FIGS. 8 and 9 show a digital display device according to a third embodiment of the present invention, in which FIG. 8 is a cricuit diagram thereof and FIG. 9 is a graph showing brightness (transmittance) vs. time in ON and OFF conditions of segments in the digital display device;

DESCRIPTION OF THE PREFERRED EMBODIMENTS

The following embodiments of the present invention are given to further illustrate the invention.

Figure 1:
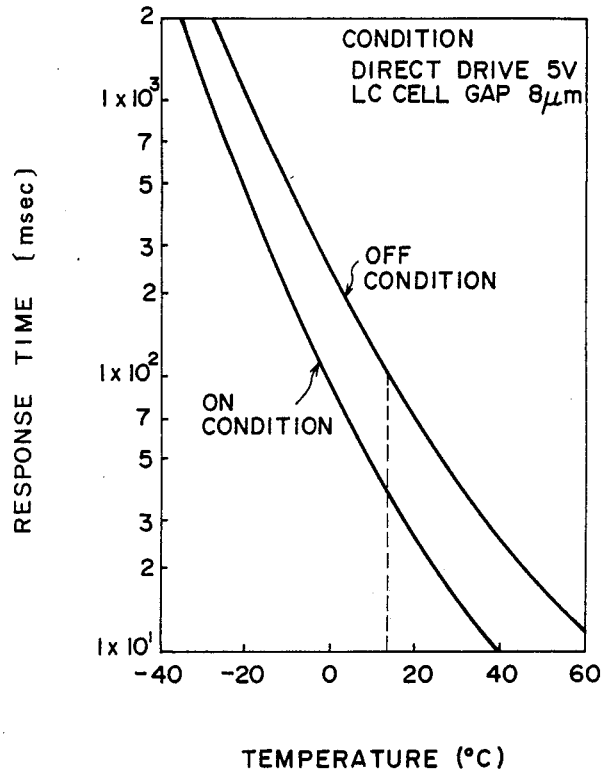
FIG. 1 is a graph shown response time vs. temperature in ON and OFF conditions of liquid crystal.
Figure 2:
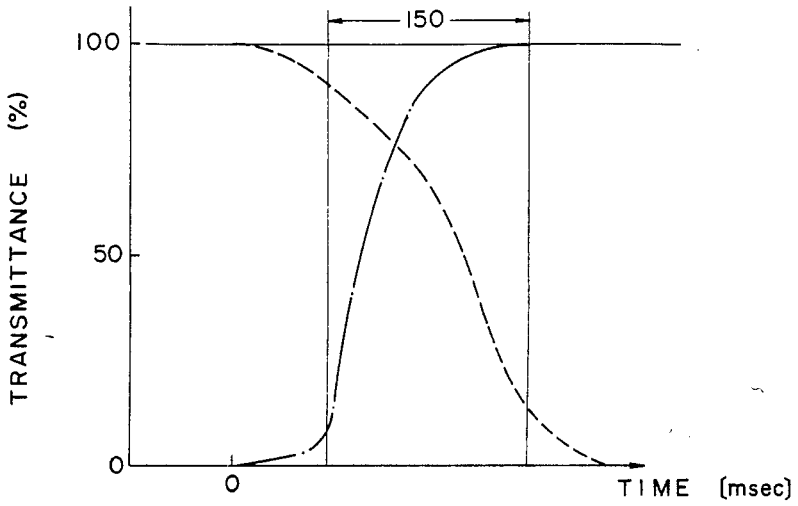
FIG. 2 is a graph showing transmittance vs. time in ON and OFF conditions of conventional liquid-crystal segments.
Figure 3:
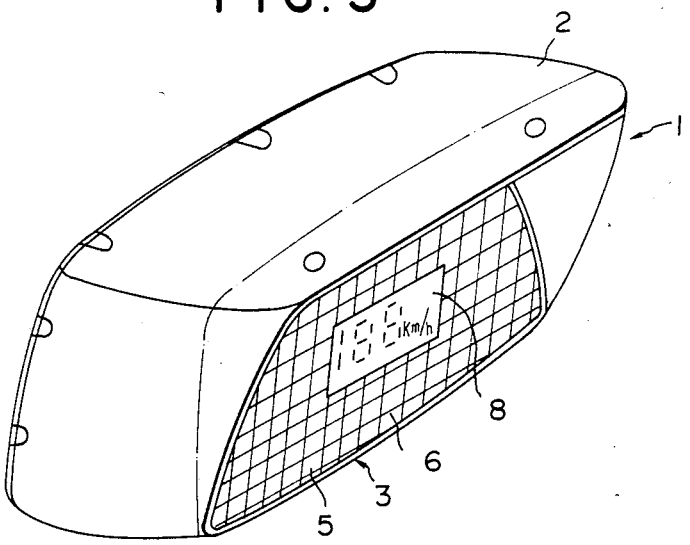
Figure 4:
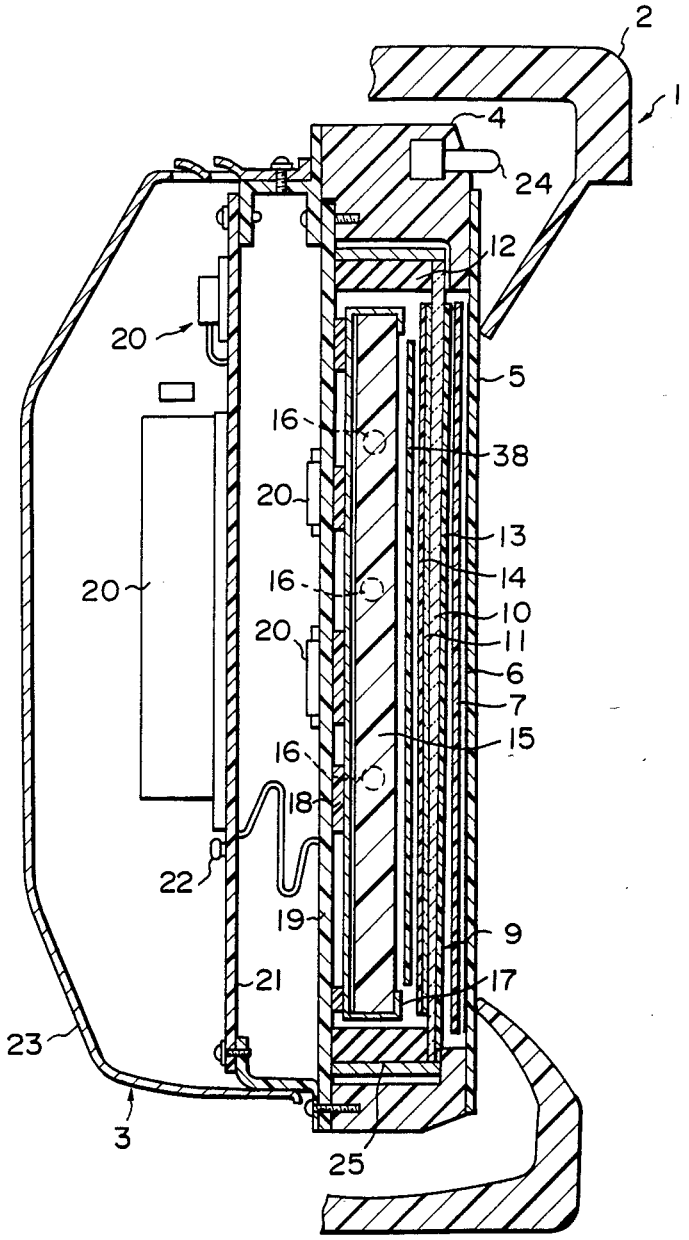

Referring first to FIGS. 3 through 6, there is shown a first embodiment, in which a vehicular speedometer 1 comprises a hood 2 and a display portion 3 as is shown in FIG. 3, the hood 2 is fixed to the vehicular body. As shown in FIG. 4, the display portion 3 has a support 4 which is fixed to the hood 2. A surface panel 5 is formed of a transparent resin plate fixed to the support 4, and on its back side (left side in FIG. 4) there is printed a lattice pattern 6 as shown in FIG. 3. A masking panel 7 is fixed to the support 4 and is disposed at the back side of the surface panel 5. The masking plate 7 is constructed of a light shielding plate formed from terephthalic acid, polyethylene, etc. and its portion corresponding to a liquid-crystal display portion 8 is made transparent. The reference numeral 9 designates a liquid-crystal panel, in which a liquid crystal cell is sealed in between a first glass plate 10 and a second glass plate 11, and electrodes are formed by screen printing on the surfaces of the first and second glass plates 10 and 11 in contact with the twisted nematic type liquid crystal cell. The electrodes are constructed of three, sideways disposed, numeric displays each consisting of seven segments so that a 3-digit numeral can be displayed. The first glass plate 10 is fixed to a supporting member 25 which is mounted to a printed board 19 as will be described later. A zebra connector 12 is constructed of a conductive rubber portion containing carbon or a finely powdered silver and an insulating rubber portion formed of silicone rubber or the like, the conductive rubber portion and the insulating rubber portion being arranged alternately with each other and connected to the electrodes of the first and second glass plates 10 and 11. A first polarizer 13 is bonded to the first glass plate 10; the first polarizer 13 and a second polarizer 14 transmit light rays of wave lengths in the same direction. A light conducting plate 15 is disposed at the back side of the second polarizer 14 and is provided on the sides thereof with illumination lamps 16. A cover 17 is formed of an aluminum plate, to the upper and lower ends of which is secured the light conducting plate 15, and the cover 17 is mounted to the printed board 19 through spacers 18. The printed board 19 is fixed to the support 4 and it carries thereon the zebra connector 12 and electronic devices 20 such as LSI. A mounting plate 21 is also fixed to the support 4, and the electronic devices 20 and a thermistor 22 are mounted thereon. A night lamp 24 is secured to the support 4, and it lights upon turning ON of a vehicular lamp switch to illuminate the surface panel 5. Numeral 38 designates a color sheet made of a colored transparent material disposed between the light conducting plate 15 and the second polarizer 14. Numeral 23 designates a case.

Figure 5:
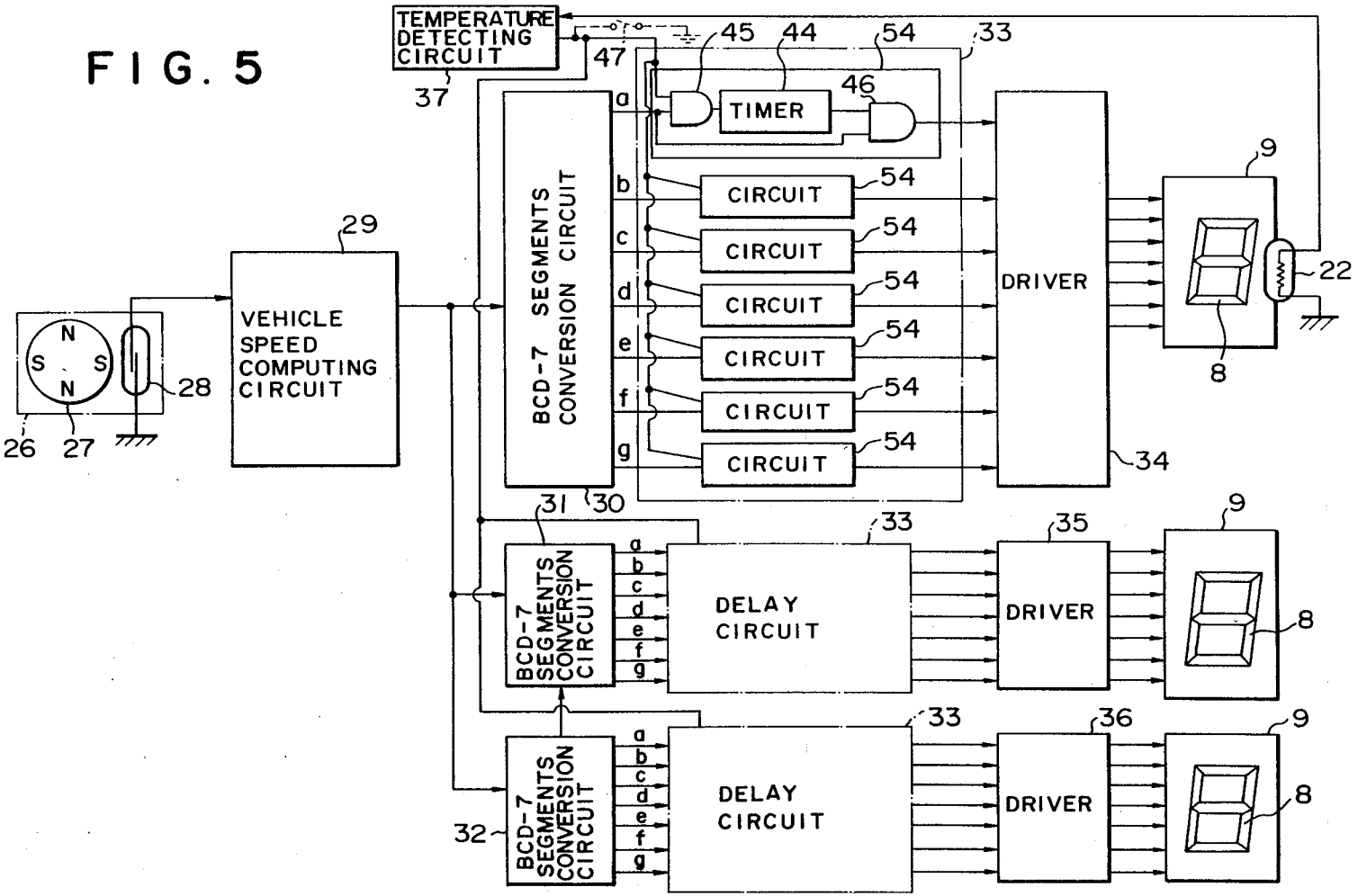

A control circuit for the liquid-crystal panel 9 of the speedometer 1 is constructed as shown in FIG. 5. That is, a vehicle speed sensor 26 comprises a magnet 27 connected for rotation to the output shaft of a vehicular transmission and a reed switch 28 is turned on and off by the magnetic force of the magnet 27. A vehicle speed computing circuit 29 computes the vehicle speed from the number or period of on-off pulses of the reed switch 28 and transmits a vehicle speed display signal to three BCD-7 segments conversion circuits 30, 31 and 32. The BCD-7 segments conversion circuits 30 through 32 transmits ON-OFF signals for the segments to drivers 34 through 36, respectively, through delay circuits. The drivers 34 through 36 provide a voltage between the electrodes constituting the segments which display a 3-digit numeral in the liquid-crystal display portion 8. The delay circuit 33 is connected to a temperature detecting circuit 37, which in turn is connected to the thermistor 22. The temperature detecting circuit 37 is connected to circuits 54 which are provided each independently for each of the segments. The circuits 54 are each constructed of a timer 44 and two AND gates 45, 46. When the temperature detected by the thermistor 22 is above 0° C., signals from the temperature detecting circuit 37 becomes "L" level so the timers 44 do not operate, and always "H" level signals are output. Therefore, when an output signal from the BCD-7 segments conversion circuit 30 has changed to "H" level, the circuit 54 provides an "H" level signal to the driver 34, allowing the driver to operate. When the ambient temperature detected by the thermistor 22 has dropped to below 0° C., the temperature detecting circuit 37 outputs "H" level signals, and if in this state an "H" level signal is provided from the BCD-7 segments conversion circuit 30, a "L" level signal is output from the AND gate 46 for a fixed period of time (150 msec). Furthermore, an "H" level signal is fed beforehand to the AND gate 45, and when an "H" level signal is again provided from the conversion circuit 30 at the time of renewal of display, the AND gate 45 is already at "H" level and therefore holds the signal as it is. The temperature detecting circuit 37 generates a voltage according to the ambient temperature of the thermistor 22, and when this temperature has dropped to below 0° C., the voltage at this moment is compared with the voltage at above 0° C. by means of a comparator, and an "H" level signal is output.

The digital display device having the hereinabove described construction operates in the following manner.

The illumination lamps 16 light upon turning ON of the main switch of a vehicle. Then, ON-OFF signals according to the vehicle speed are fed from the vehicle speed sensor 26 to the vehicle speed computing circuit 29, which in turn computes the vehicle speed from the ON-OFF signals and transmits the results of the computation to the BCD-7 segments conversion circuits 30 through 32, whereupon the conversion circuits 30 through 32 generates ON-OFF signals for the segments of the liquid-crystal panel 9.

When the temperature of the thermistor 22 is above 0° C., the temperature detecting circuit 37 does not operate so the delay circuits 33 are kept off. Consequently, the output signals from the conversion circuits 30 through 32 are sent immediately to the drivers 34 through 36, respectively, applying voltage to segments of the liquid-crystal panel 9 which are to represent the vehicle speed. As a result, the light of the light conducting plate 15 which is kept luminous by the illumination lamps 16 go ahead to the right in FIG. 4, passes through the color sheet 38, reaches the liquid-crystal panel 9 and passes through only the segments to which the voltage was applied, allowing the vehicle speed to be displayed digitally on the surface panel 5. Thereafter, at every predetermined time interval (e.g. 400 msec, hereinafter referred to as the display holding time), the vehicle speed computing circuit 29 computes a new vehicle speed and send the results of the computation to the drivers 34 through 36 to renew the display of vehicle speed. That is, the drivers 34 through 36 allow the segments to hold the same display for a certain period of time.

Figure 6:
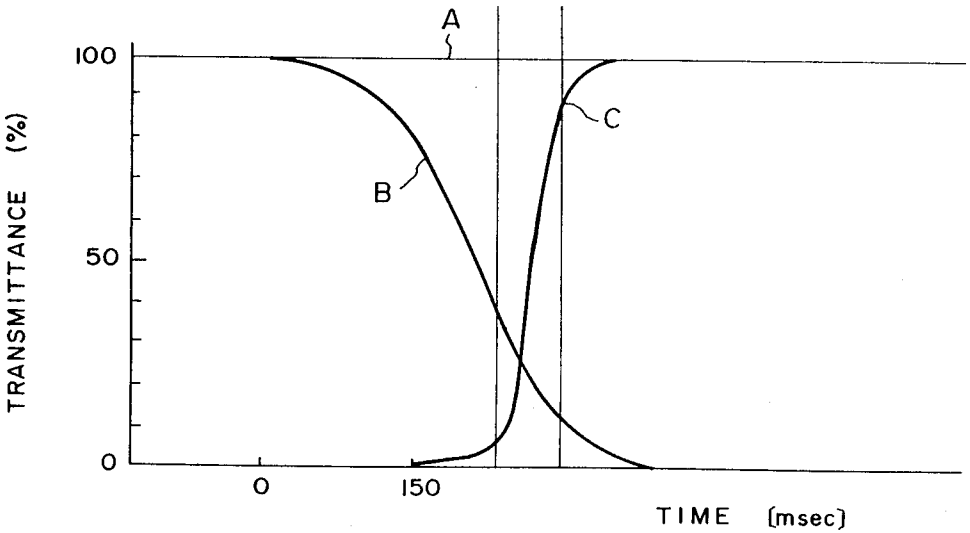

When the temperature of the thermistor 22 has dropped to below 0° C., the temperature detecting circuit 37 operates the delay circuit 33. For example, if the state of segments "a " and "b" being lit by the BCD-7 segments conversion circuit 30 continues for 400 msec, and if the BCD-7 segments conversion circuit 30 generates signals to turn on segments "a" and "c" and turn off the segment "b" on the basis of a vehicle speed renewal signal provided from the vehicle speed computing circuit 29, the delay circuit 33 transmits an ON signal for the "a" segment immediately to the driver 34 whereby the "a" segment continues to light as is shown in FIG. 6A, while for the "b" segment an OFF signal provided immediately from the BCD-7 segments conversion circuit 30 through the delay circuit 30 whereby the segment "b" begins to turn off in the position of the renewal signal as is shown in FIG. 6. However, since the temperature of the liquid crystal 9 is low, the initial state is not immediately returned even after removal of the voltage, and the segment "b" exhibits such a change in transmittance as shown in FIG. 6B.

On the other hand, an ON signal for the "c" segment is provided from the BCD-7 segments conversion circuit 30 to the delay circuit 33, where it is held for 150 msec, and then delivered to the driver 34. Consequently, the "c" segments exhibits such a change in transmittance as shown in FIG. 6C, and the segments "a" and "c" continue to light for 400 msec after the ON signal for the "c" segment was sent to the driver 34.

Thus, at temperatures below 0° C. at which the liquid crystal responds slowly, the liquid crystal forming the segment which was OFF is turned ON 150 msec behind when renewing the display, so that the segment which has been ON and the segment about to be turned ON overlap each other. For example, therefore, when displaying "2" after the previous display of "1", there does not appear "3". Thus, there scarcely occurs an overlapped display, so the discriminatability is improved and it is possible to prevent misunderstanding by the vehicle driver who glances at the vehicular speedometer for an instant.

In the above embodiment the thermistor 22 is mounted on the mounting plate 21, but it may be disposed anywhere else, for example, on the printed board 10, except near heating sources such as lamp and LSI in the display portion 3.

The delay circuit 33 may be operated manually not by the temperature detecting circuit 37. Furthermore, as shown in broken lines in FIG. 5, if a manual switch 47 is connected to the delay circuit 33, the delay circuit 33 can be operated manually whenever desired.

Additionally, in the case of a vehicular speedometer, the display of the third digit, i.e. its 100's order digit, undergoes very little change, so the delay circuit 33 disposed between the BCD-7 segments conversion circuit 32 and the driver 36 may be omitted.

Figure 7:
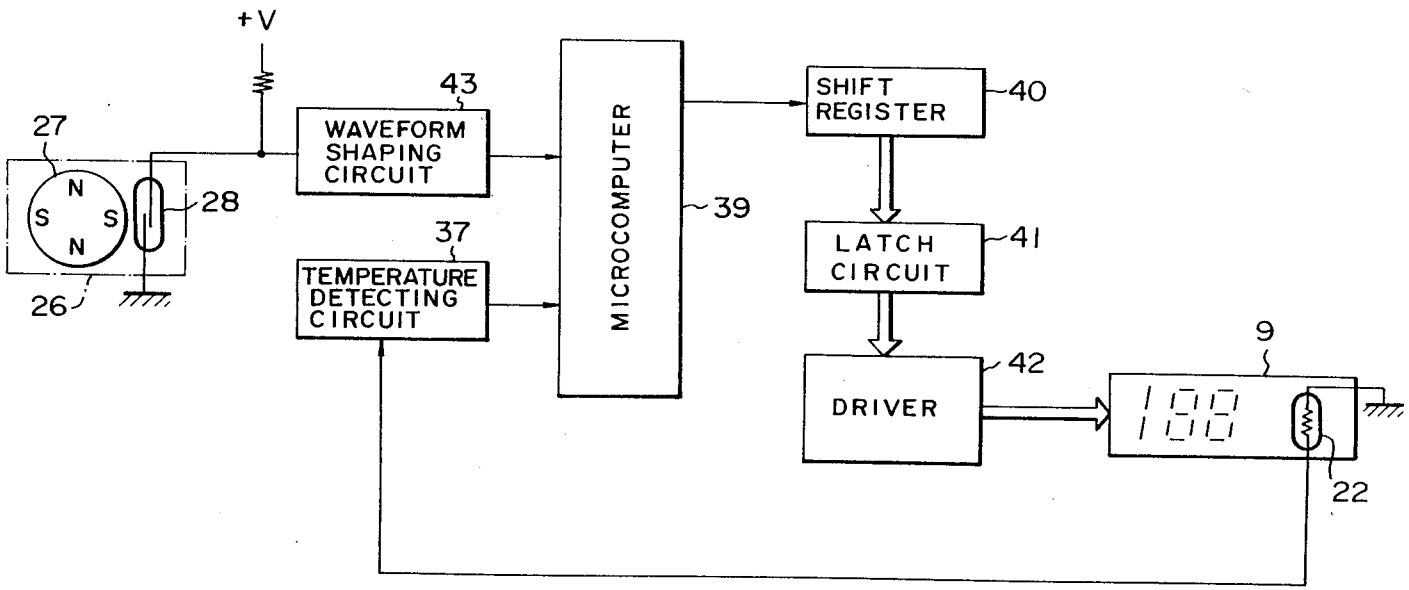
FIG. 7 is a circuit diagram of a digital display device according to a second embodiment of the present invention.

In the second embodiment shown in FIG. 7, the circuit according to the first embodiment shown in FIG. 5 was formed using a microcomputer. Numeral 39 designates a microcomputer which incorporates a vehicle speed computing section and a delay circuit section to make ON-OFF control for the segments each independently. Numerals 40, 41, 42 and 43 designate a shift register, a latch circuit, a driver and a waveform shaping circuit, respectively.

Figure 8:
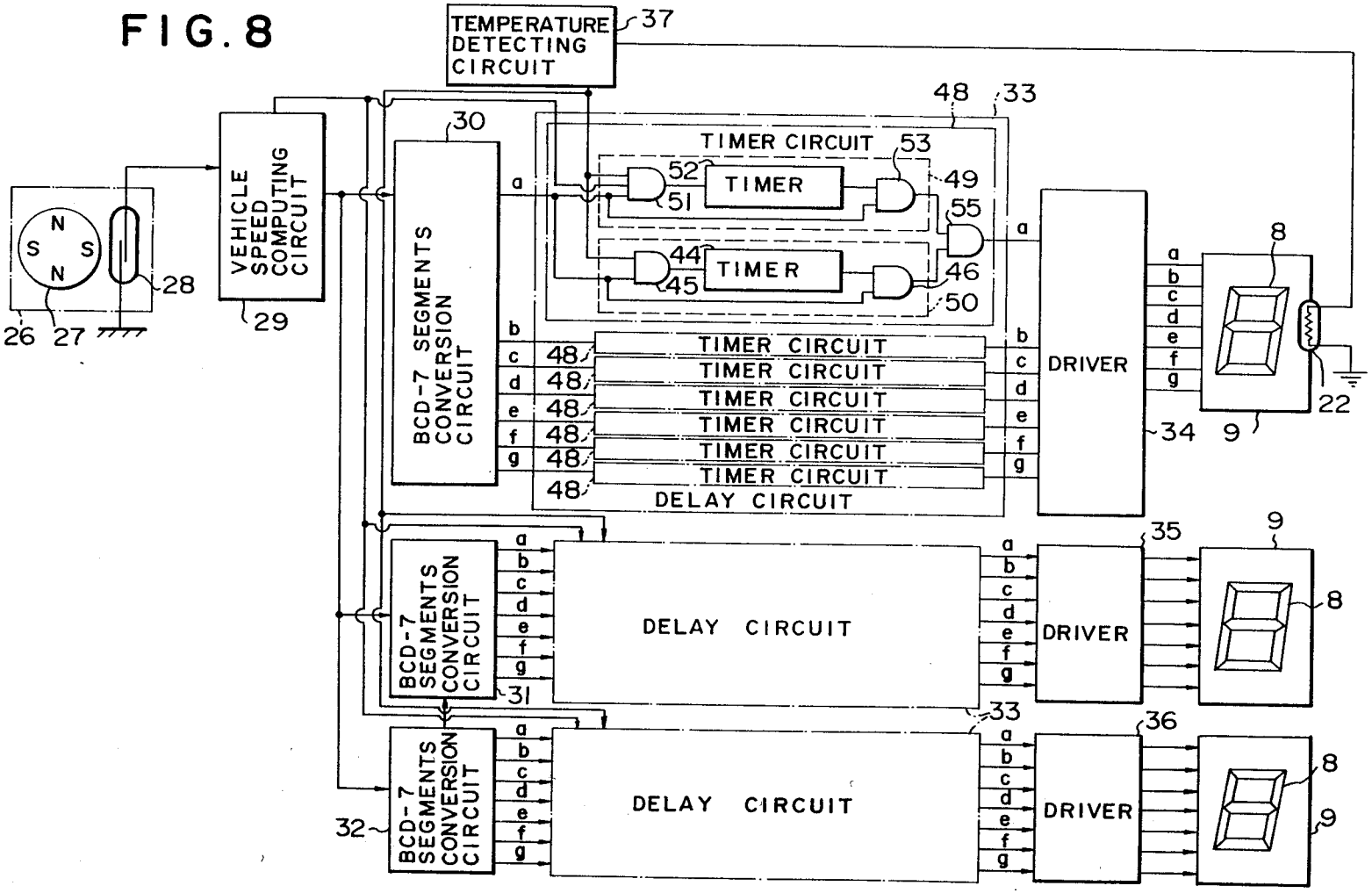
Figure 9:
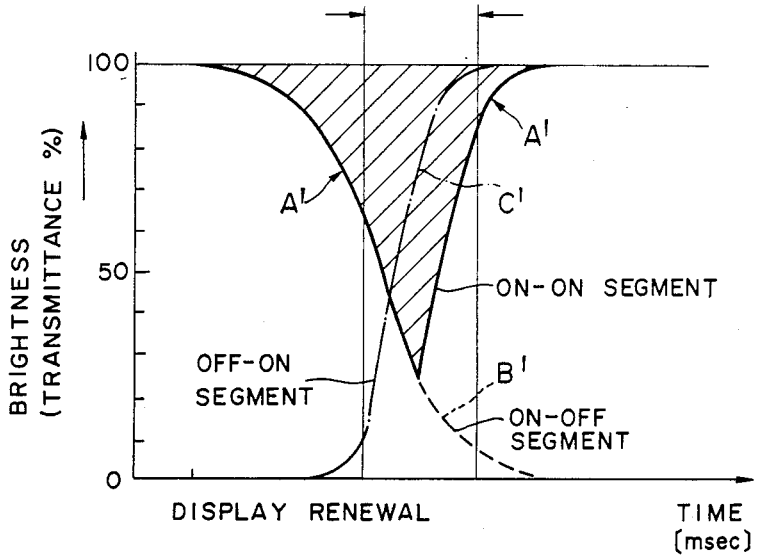

In the third embodiment shown in FIGS. 8 and 9, the construction of the delay circuit of the digital display device shown in the first embodiment was changed so that when renewing display, OFF signals are once provided to all the segments. The components common to the first embodiment will be marked with the same reference numerals.

In FIG. 8, the vehicle speed computing circuit 29 provides vehicle speed signals to the BCD-7 segments conversion circuits 30, 31 and 32, and transmits display renewal signals to timer circuits 48 which are in corresponding relation to the segments of each delay circuit 33. The timer circuit 48 comprises a first timer circuit 49 and a second timer circuit 50. The first circuit 49 comprises a 3-input AND gate 41 to which are fed the display renewal signal output of the vehicle speed computing circuit 29, the segment display output of the BCD-7 segments conversion circuit 30 and the temperature signal output of the temperature detecting circuit 37, a timer 52 connected to the AND gate 51, and an AND gate 53 to which are provided the output of the timer 52 and the segment display output of the BCD-7 segments conversion circuit 30. The second circuit 50 is the same as the circuit 54 in the first embodiment. The output of the first circuit 49 and that of the second circuit 50 are connected through a third AND gate 55 to the drivers 34 through 36.

The following description is now provided about the operation on the basis of the construction described above.

In FIG. 8, the vehicle speed sensor 26 transmits a signal according to the speed of the running vehicle to the vehicle speed computing circuit 29, which computes the vehicle speed, and the BCD-7 segments conversion circuits 30 through 32 send ON-OFF signals to the drivers 34 through 36 through the delay circuit 33 to turn each segment ON or OFF. If the temperature is below 0° C., the thermistor 22 turns ON and a "H" level signal is output from the temperature detecting circuit 37 to operate the delay circuit 33.

For example, if the BCD-7 segments conversion circuit 30 turned ON the segments "a" and "b" and if in this state a change in vehicle speed when renewing display after the lapse of the display holding time (400 msec) requires turning ON of the segments "a" and "c" and turning OFF of the segment "b", then to the AND gate 51 of the timer circuit 48 corresponding to the "a" segment there are fed a display renewal signal from the vehicle speed computing circuit 29, a signal indicating a drop in temperature below 0° C. from the temperature detecting circuit 37 and an "a" segment ON signal from the BCD-7 segments conversion circuit 30, and the gate 51 provides a signal to the timer 52, which in turn provides a "L" level signal to the AND gate 53 for a certain period of time (150 msec) to bring the gate 53 into "L" level. Then, the AND gate 55 is made "L" level and the segment "a" is turned OFF through the driver 34. After the lapse of 150 msec from the time when the display renewal signal was generated, the timer 52 outputs a "H" level signal, and the AND gate 53 outputs a "H" level signal because the portion corresponding to the "a" segment of the BCD-7 segments conversion circuit 30 outputs a "H" level signal. The second circuit 50 continues to output a "H" level signal because the portion corresponding to the "a" segment of the BCD-7 segments conversion circuit 30 continues to output a "H" level signal and the temperature detecting circuit 37 also continues to output "H" level. Consequently, the AND gate 55 outputs a "H" level signal to turn ON the segment "a". In this case, as shown in FIG. 9A', the segment "a" becomes dark because it is turned OFF upon generation of the display renewal signal, and after the lapse of 150 msec it is again turned ON and grows light.

The "b" segment is turned OFF upon generation of an OFF signal from the BCD-7 segments conversion circuit 30, and in this case its brightness changes as shown in FIG. 9B'.

Furthermore, with respect to the "c" segment, the timer 44 of the second circuit 50 is operated with an ON signal provided from the BCD-7 segments conversion circuit 30 and a signal from the temperature detecting circuit 37 and outputs a "L" level signal for a certain period of time (70 msec), and "L" level signals are output from the AND gates 46 and 53, so the segment "c" is not turned ON. Then, after the lapse of 70 msec, the timer 44 outputs a "H" level signal, and the AND gate 46 outputs a "H" level signal because the BCD-7 segments conversion circuit 30 is outputting a "H" level signal. The AND gate 51 outputs a "H" level signal only when it receives a display renewal signal after pre-input thereto "H" level signal from the BCD-7 segments conversion circuit 30 and "H" level signal from the temperature detecting circuit 37. If the AND gate 51 receives the said display renewal signal and an ON signal from the BCD-7 segments conversion circuit 30 simultaneously, it does not operate, so the timer 52 remains outputting a "H" level signal, and the AND gate 53 which receives an ON signal from the conversion circuit 30 outputs a "H" level signal. Consequently, the AND gate 55 outputs a "H" level signal and turns ON the segment "c" after thelapse of 70 msec from the time when the display renewal signal was generated. In this case, the brightness of the "c" segment changes as shown in FIG. 9C'.

The BCD-7 segments conversion circuits 30 through 32, the delay circuits 33 and the drivers 34 through 36 operate in the same manner as mentioned above to operate the segments in each liquid-crystal panel 9 in the same way as explained above at the time of "ON→ON", "ON→OFF" and "OFF→ON".

The display holding time in the above embodiment is 400 msec, including the delay time set by the timers 44 and 52.

Therefore, at a low temperature below 0° C., for example, if "ᒉ" is to be displayed after the display of "ᒉ", OFF signals are once provided to all the segments of "ᒉ" as is shown in FIG. 9, and after the luminance of the display "ᒉ" becomes sufficiently small, the display of "ᒉ" is made. Therefore, unlike the prior art devices, the display of "ᒉ" resulting from overlap of "ᒉ" and "ᒉ" will never be recognized. As a result, the discriminatability is improved and the misunderstanding of display can be prevented.

In the foregoing first to third embodiments the temperature detecting circuit 37 outputs a low temperature signal ("H") at a temperature below 0° C., but this temperature should be chosen suitably at the design stage if only it corresponds to the temperature at which the delay in response speed of liquid crystal when turning off becomes large, or lower temperatures, for example, it may be 10° C., 0° C., or −10° C. provided this condition is satisfied.

In the foregoing third embodiment, the operation time of the timer 44 and that of the timer 52 were set to 70 msec and 150 msec, respectively, but their times to be set may be changed as necessary. In that embodiment, moreover, the operation time of the timer 44 was set longer than that of the timer 52, but the reverse is also applicable. Furthermore, in FIG. 9, the operation time of the timers 44 and 52 may be adjusted so that the increase in luminance of the "a" segment A' and that of the "c" segment C' become the same.

Figure 10:
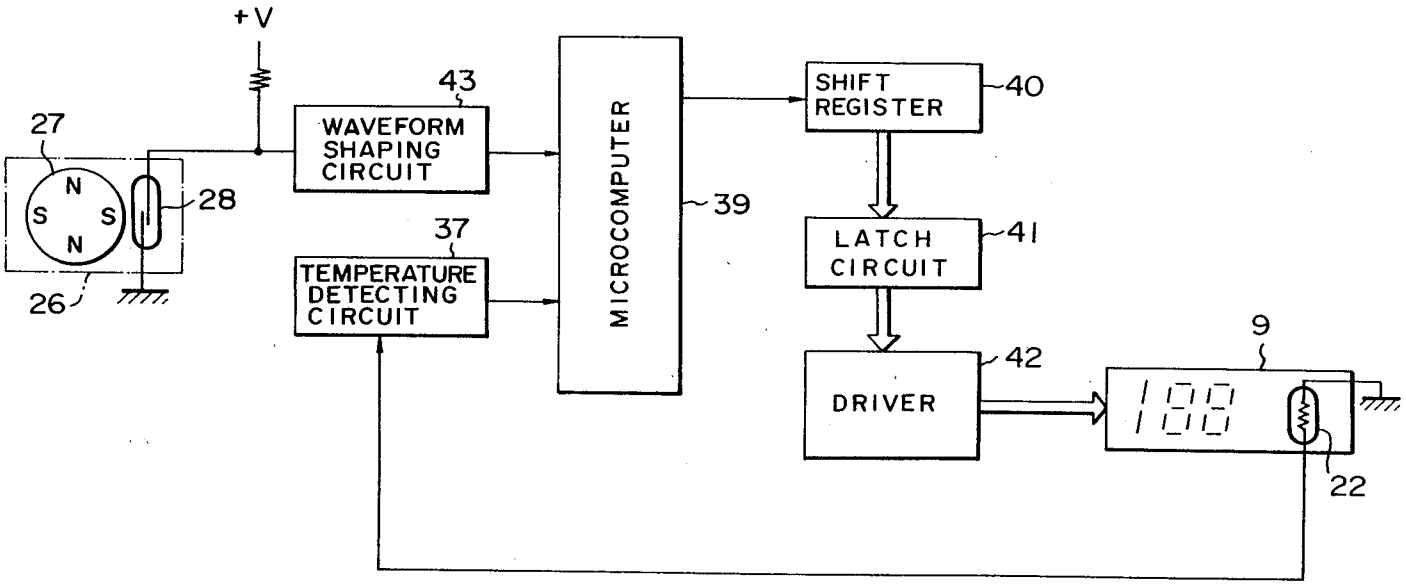
FIG. 10 is a circuit diagram of a digital display device according to a fourth embodiment of the present invention.

In the fourth embodiment illustrated in FIG. 10, the vehicle speed computing circuit 29, the BCD-7 segments conversion circuits 30 through 32 and the delay circuits 33, which are shown in the third embodiment, were substituted by the microcomputer 39, and the operation is the same as in the third embodiment.

Figure 11:
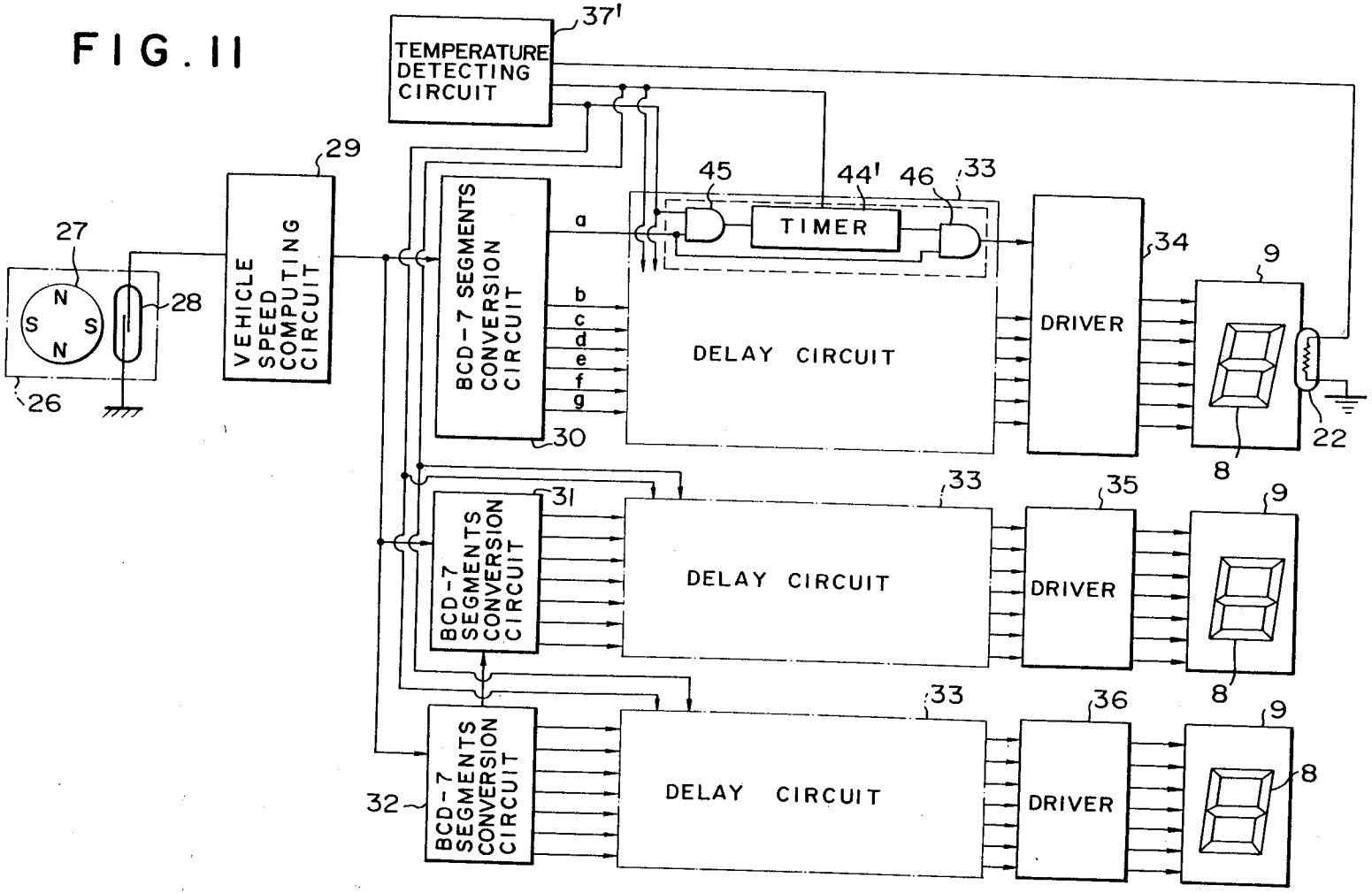
FIG. 11 is a circuit diagram of a digital display device according to a fifth embodiment of the present invention.

In the fifth embodiment illustrated in FIG. 11, the timer 44 shown in the first embodiment is made a time constant variable type, and the temperature detecting circuit 37 is constructed so that it provides a time constant control signal to the timer 44 according to temperatures.

That is, when a temperature detecting circuit 37' receives a voltage according to the temperature of the thermistor 22, it compares the voltage in a comparator and detects to which of the following ranges the temperature belongs, above 10° C. incl., below 10° C. and above 0° C. incl., below 0° C. and above −10° C. incl., below −10° C. and above −20° C. incl., below −20° C. When the temperature is above 10° C incl., the temperature detecting circuit 37' outputs a "L" level signal to the AND gate 45 and does not provide a time constant control signal to a timer 44'. When the temperature is below 10° C. and above 0° C. incl., the temperature detecting circuit 37' outputs and "H" level signal to the AND gate 45 and provides to the timer 44' a signal for setting the time constant to 30 msec. When the temperature is below 0° C. and above −10° C. incl., the circuit 37' outputs a "H" level signal to the AND gate 45 and transmits to the timer 44' a signal for setting the time constant to 60 msec. Furthermore, when the temperature is below −10° C. and above −20° C. incl., the circuit 37' outputs a "H" level signal to the AND gate 45 and transmits to the timer 44' a signal for setting the time constant to 90 msec. And when the temperature is below −20° C., the circuit 37' outputs a "H" level signal to the AND gate 45 and transmits to the timer 44' a signal for setting the time constant to 120 msec. With the time constant control signal from the temperature detecting circuit 37', the timer 44', upon receipt of an input signal "H" from the AND gate 45, brings the aforesaid time constant output to "L".

Thus, the time constant (delay time) of the timer 44' can be set longer with lowering of temperature enough to approximate the increase in response delay of liquid crystal caused by the drop of temperature. As a result, the discriminatability is improved.

The temperature range and the time constant of the timer in the above embodiment may be described in view of the properties of liquid crystal and of the discriminatability of each segment.

If the temperature detecting circuit 37' and the timer 44' in the above embodiment are substituted for the temperature detecting circuit 37 and the timer 44 in the third embodiment, and if the timer 52 is made a time constant variable time, the delay circuit 33 in the third embodiment is allowed to increase the lighting delay time with lowering of temperature to decrease the overlap of display. In this case, the time constant of the timer 44' and that of the timer 52 are optional, and it is also optional to increase their time constant as the temperature falls.

Figure 12:
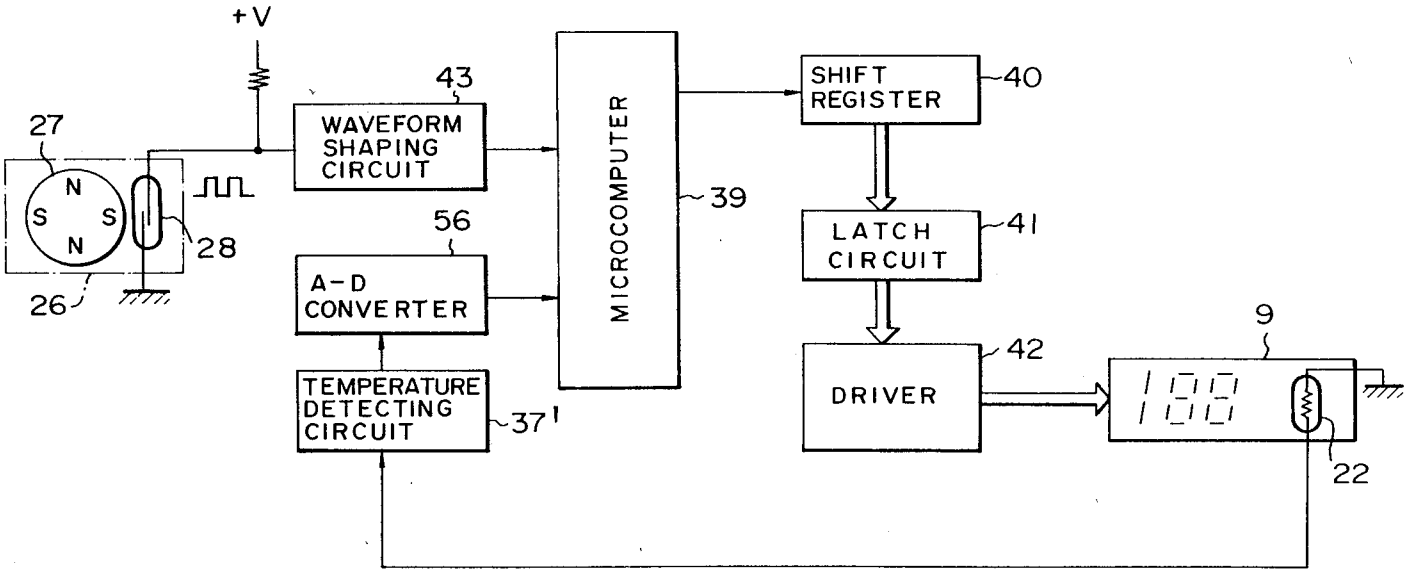
FIG. 12 is a circuit diagram of a digital display device according to a sixth embodiment of the present invention.

In the sixth embodiment illustrated in FIG. 12, the operation of the fifth embodiment is performed by using the microcomputer 39. In this embodiment, the vehicle speed computing circuit 29, the BCD-7 segments conversion circuits 30 through 32 and the delay circuit 33 are constructed of the microcomputer 39 and the waveform shaping circuit 43, and A-D converter 56 is disposed between the temperature detecting circuit 37' and the microcomputer 39.

What is claimed is:

1. A digital display device comprising, a plurality of segments having means for performing a digital display, a driver for turning said segment on and off, delay apparatus, a controlling apparatus for supplying through said delay apparatus to said driver an activating signal for activating a segment which has been off and an OFF signal for turning off a segment which has been activated, temperature detecting means for detecting the ambient temperature in the environment of said segments, and said delay apparatus having means for delaying the activating signal received from said controlling apparatus during a predetermined time after the OFF signal is supplied from said controlling apparatus to said driver when ambient temperature detected by said temperature detecting means is lower than a predetermined value, whereby at each renewal of display all renewed segments are brought to a similar off state and thus are renewed substantially synchronously.

2. A digital display device according to claim 1, wherein said segments are formed of liquid crystal.

3. A digital display device according to claim 1, wherein said segments are formed of electrochromic material.

4. A digital display device according to claim 1, wherein said predetermined value of ambient temperature is 10° C.

5. A digital display device according to claim 1, wherein the time interval from one display renewal to the next display renewal is constant.

6. A digital display device according to claim 1, wherein said controlling apparatus comprises means for maintaining constant a duration time from the output of an ON signal for turning on a segment to the output of the following OFF signal for turning off the same segment.

7. A digital display device according to claim 1, wherein said controlling apparatus supplies through said delay apparatus to said driver OFF signals for turning off all the segments which have been activated till the time of renewal of digital display.

8. A digital display device according to claim 7, wherein said delay apparatus comprises means for suspending during a first predetermined time activating signals to be sent for activating segments which have been off till the time of renewal, said controlling apparatus having means for supplying through said delay apparatus OFF signals once for turning off segments which have been activated at the time of renewal and will be activated again after that, and said delay apparatus comprises means for delaying during a second predetermined time following activating signals after said OFF signals are supplied.

9. A digital display device according to claim 8, wherein said first predetermined time is shorter than said second predetermined time.

10. A digital display device according to claim 8, wherein said first and second predetermined times are set so that the brightness at the time of elapse of said second predetermined time of the segments to which ON signals are sent after the lapse of said first predetermined time, and the brightness of the segments which were ON when the renewal of display is about to be made and to which OFF signals are sent upon renewal of display and then ON signals are sent after the lapse of said second predetermined time, are equal to each other.

11. A digital display device according to claim 1, wherein said delay apparatus responds to said temperature detecting means so that when the ambient temperature in renewing display is lower than said predetermined value, said predetermined time is increased according to the lowering of the temperature.

12. A digital display device according to claim 8, wherein said delay apparatus responds to said temperature detecting means so that said first and second predetermined times are increased according to the lowering of the ambient temperature.

13. A digital display device comprising, a multiplicity of segments for performing a digital display, a driver for turning said segments on and off, delay apparatus, a controlling apparatus having means for supplying through said delay apparatus to said driver an activating signal for activating a segment which has been turned off and an OFF signal for turning off a segment which has been activated, said delay apparatus having means for delaying the activating signal received from said controlling apparatus during a predetermined time after the OFF signal is supplied from said controlling apparatus to said driver, and a manual switch for actuating said delay apparatus, whereby at each renewal display all renewed segments are brought to a similar off state and thus are renewed substantially synchronously.

* * * * *